US005104501A

United States Patent [19]

Okabayashi

[11] Patent Number: 5,104,501

[45] Date of Patent: Apr. 14, 1992

[54] ELECTROLYTIC CLEANING METHOD AND ELECTROLYTIC CLEANING SOLUTION FOR STAMPER

[75] Inventor: Norio Okabayashi, Himeji, Japan

[73] Assignee: Daicel Chemical Industries, Ltd., Osaka, Japan

[21] Appl. No.: 535,387

[22] Filed: Jun. 8, 1990

[30] Foreign Application Priority Data

Jun. 13, 1989 [JP] Japan ..... 1-151415

[51] Int. Cl.[5] ..... C25F 1/00; C11D 7/54

[52] U.S. Cl. ..... 204/141.5; 252/135; 252/174.14; 252/174.19

[58] Field of Search ..... 204/141.5, 129.1, 129.95, 204/129.75, 32.1, 5; 252/135, 136, 174.14, 174.19; 106/1.05

[56] References Cited

U.S. PATENT DOCUMENTS

| | | | |
|---|---|---|---|
| 3,094,469 | 6/1963 | Strauss et al. | 204/141.5 |
| 3,219,520 | 11/1965 | Box | 204/141.5 X |
| 3,419,501 | 12/1968 | Levy | 252/135 X |
| 3,457,151 | 7/1969 | Kortejarvi | 204/141.5 X |
| 3,939,046 | 2/1976 | Conn et al. | 204/141.5 X |
| 4,010,086 | 3/1977 | Barrett et al. | 204/141.5 |
| 4,305,795 | 12/1981 | Weaver | 204/140 |
| 4,514,270 | 4/1985 | Furutani et al. | 204/151 |
| 4,521,332 | 6/1985 | Milora | 252/135 X |
| 4,537,666 | 8/1985 | Murray et al. | 204/129.95 |
| 4,729,940 | 3/1988 | Nee et al. | 204/129.95 X |
| 4,746,453 | 5/1988 | Chen et al. | 252/135 |
| 4,762,638 | 8/1988 | Dollman | 252/135 |

*Primary Examiner*—Donald R. Valentine
*Attorney, Agent, or Firm*—Cohen, Pontani, Lieberman & Pavane

[57] ABSTRACT

An improved electrolytic cleaning method for stamper which comprises suspending a stamper and an opposite electrode plate in an electrolytic stamper cleaning solution as opposed to each other by an electrode jig, the opposite electrode plate and the electrode jig each being made of substantially the same material as that of the stamper, and applying a DC voltage between the stamper and the opposite electrode so that the former serves as an anode and the later serves as a cathode to perform electrolytic cleaning under agitation of the cleaning solution.

8 Claims, 2 Drawing Sheets

(a) Before Cleaning (b) After Cleaning (a) Before Cleaning (b) After Cleaning

ELECTROLYTIC CLEANING METHOD AND ELECTROLYTIC CLEANING SOLUTION FOR STAMPER

BACKGROUND OF THE INVENTION

1. Field of the Invention

The present invention relates to an electrolytic cleaning method and an electrolytic cleaning solution for a stamper. The present invention particularly relates to an improved electrolytic cleaning method and an improved electrolytic cleaning solution for cleaning a stamper by electrolytically degreasing it.

2. Description of the Prior Art

Stampers, i.e., masters used for duplicating information recording disks such as LP records, optical disks and the like, are generally produced by the following process:

A glass matrix is first polished, and a photosensitive resin film is then coated on the polished surface thereof. A desired fine pattern is formed by optical etching, and a film of a metal such as nickel is then provided on the fine pattern surface. Building-up is then effected by electroplating until a desired- thickness is obtained, and the thus-formed plate is then separated from the glass matrix to form a stamper.

Since the photosensitive resin film remains on the surface of the stamper, however, the resin film must be removed.

Methods used for removing such a film include an electrolytic degreasing cleaning method for electrolytically degreasing by using a usual alkali electrolytic cleaning solution which is a mixed solution containing an alkali and a surfactant (for example, an alkali concentration of about 1%), an ultrasonic cleaning method for cleaning by using ultrasonic waves in an organic solvent and combination of the two cleaning methods.

In a method known as the electrolytic degreasing cleaning method, electrolysis is effected by using as a cathode a stamper (made of nickel), which is suspended by an electrode jig made of copper or stainless steel in an alkali electrolytic degreasing cleaning solution, and as an anode the opposite electrode plate made of stainless (refer to Japanese Patent Laid-Open No. 62-214535). In this method, the solubility of the photosensitive resin film remaining on the surface of the stamper in an alkali is utilized for dissolved the resin film, and the physical function of the occurrence of a large quantity of hydrogen gas is utilized for removing it.

In recent years, the use of information recording disks as optical disks, from which recorded information is optically extracted, has been rapidly advanced in various fields, apart from conventional LP records. In such optical disks, the width of a groove for recording information is 0.5 μm which is 1/100 of 50 μm of LP records.

On the other hand, the fine particles remaining on the stamper, which is used for duplicating disks and cleaned by one of the above various cleaning methods, have a size of 1 to 10 μm.

Since a conventional stamper used for duplicating LP records (or for analogue) has an information recording groove having a width of about 50 μm, therefore, the remaining fine particles have little effect on the stamper, and a sufficient degree of cleaning can be obtained by the conventional cleaning methods.

However, since a stamper for duplicating optical disks (or for digital) has an information recording groove having a width of about 0.5 μm, information recording is fatally affected even by fine particles of 1 μm. The stamper for duplicating optical disks must be cleaned with a degree of cleaning which is significantly higher (residue: 1/100 or less) than that of cleaning of the stamper used for duplicating LP records. Such a high degree of cleaning cannot be easily attained by the above-described conventional electrolytic degreasing cleaning method, ultrasonic cleaning method and the like.

SUMMARY OF THE INVENTION

The present invention provides a method of electrolytically cleaning a stamper which comprises suspending a stamper and an opposite electrode plate in an electrolytic stamper cleaning solution as opposed to each other by an electrode jig, the opposite electrode plate and the electrode jig each being made of substantially the same material as that of the stamper, and applying a DC voltage between the stamper and the opposite electrode so that the former serves as an anode and the later serves as a cathode to perform electrolytic cleaning under agitation of the cleaning solution.

The present invention is based on the finding of the fact that an excellent degree of cleaning can be unexpectedly obtained in a short time when the electrode jig for the stamper and the opposite electrode plate are made of substantially the same material as that of the stamper, and when electrolysis is progressed in such a manner that the electrolytic polarity of the stamper is positive, and that of the opposite electrode plate is negative, i.e., the electrode polarity is reversed.

In the cleaning method of the present invention, a usual alkali electrolytic cleaning solution can be used as the solution for electrolytically cleaning the stamper. If a cleaning solution obtained by adding a specific amount of ethylenedianinetetraacetic acid (EDTA) or an alkali salt thereof to the alkali electrolytic cleaning solution is used, the above cleaning method with a high degree of cleaning can be performed with good reliability for a long time. This EDTA-containing cleaning solution is novel.

The present invention therefore also provides a solution for electrolytically cleaning a stamper which is an alkali electrolytic cleaning solution containing 1 to 100 mg/l of ethylenediaminetetraacetic acid and/or an alkali salt thereof.

DETAILED DESCRIPTION OF THE PREFERRED EMBODIMENTS

Figure 1:
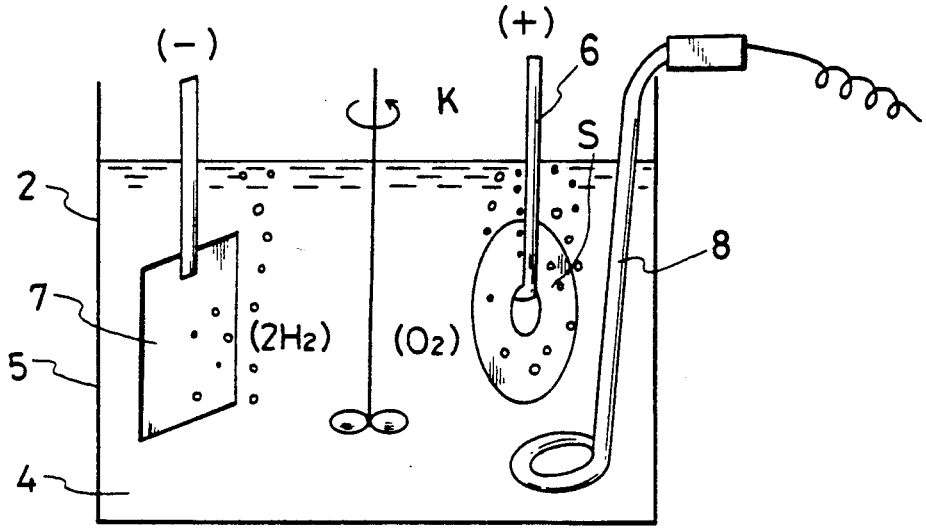
FIG. 1 is an explanatory view of the function of an apparatus for performing a stamper cleaning method in accordance with the present invention.

In the present invention, an electrode jig for suspending and holding a stamper in a cleaning solution and an electrode plate opposite to the stamper are made of the material which is substantially the same as that of the stamper. Such a material hardly produces a potential difference (has no function as a battery) between the stamper and the electrode jig and the opposite electrode plate when electrolysis is effected by using as an anode the stamper and as a cathode the opposite electrode plate. The material which is entirely the same as that of the stamper is thus preferable. Preferable examples of materials for the stamper, the electrode jig and the opposite electrode plate include metals such as nickel, cobalt, platinum, molybdenum, chromium, tungsten, vanadium, niobium, tantalum, palladium, gold and the like. Stainless steel and copper alloys are undesirable because they are eroded by an alkali bath (alkali: at least 5% aqueous solution of caustic soda) at high temperature (about 50° C. or more, generally 50° to 60° C.). The use of a nickel stamper and a copper electrode jig is also undesirable because, since the standard oxidation reduction potentials are greatly different, a potential difference is produced between them and causes the oxidation and blackening (so-called "burning") of the contact portion therebetween.

Various known alkali electrolytic cleaning solutions which are used for stampers can be used as the electrolytic stamper cleaning solution in the present invention. Preferable examples of cleaning solutions include aqueous solutions each of which contains at least one of alkali hydroxides such as sodium hydroxide, potassium hydroxide and the like and weak acid alkali salts such as sodium carbonate, sodium phosphate, sodium silicate and the like, and an appropriate surfactant. However, the cleaning solution may contain other additives. Although the concentration of the total alkali agents depends upon the electrolytic conditions used for electrolytic cleaning, it is preferably 5 to 25% by weight. The amount of the surfactant added is preferably within the range of $0.05\times10^{-2}$ to $0.2\times10^{-2}$% by weight. The surfactant is added for the purpose of improving the wetting properties of the stamper. Preferable examples of surfactants that may be used include anionic surfactants such as alkyl sulfates, higher fatty acid salts, alkylbenzene sulfonates and the like; and nonionic surfactants such as higher alcohol ethylene oxide addition products, alkylphenol ethylene oxide addition products, polyhydric alcohol fatty acid ester ethylene oxide addition products, aliphatic amide ethylene oxide addition products and the like.

One preferable example of such alkali electrolytic cleaning solutions is an aqueous solution containing 3 to 5% by weight of sodium hydroxide, 3 to 5% by weight of sodium carbonate, 5 to 8% by weight of sodium phosphate, 3 to 5% by weight of sodium silicate and a small amount of surfactant.

When an aqueous solution obtained by adding 1 to 1000 mg/l of ethylenediaminetetraacetic acid (EDTA) and/or an alkali salt thereof to the alkali electrolytic cleaning solution is used, cleaning with a high degree of cleaning can be continued with good reliability for a longer time. The use of such a EDTA-containing cleaning solution is therefore preferable.

Examples of alkali salts of ethylenediaminetetraacetic acid include dialkali metal salts, tetraalkali metal salts and the like. For example, disodium ethylenediaminetetraacetate and tetrasodium ethylenediaminetetraacetate are preferable.

Such ethylenediaminetetraacetic acid and/or alkali salts thereof have the function to inhibit the deposition and adhesion of various metal ions, which are present as impurities in the system, to the stamper on the basis of the chelate function, without inhibiting the excellent cleaning function obtained in the present invention. As a result, the life of the cleaning solution is significantly increased. The amount of the ehtylenediaminetetraacetic acid and/or alkali salt mixed is preferably 10 to 100 mg/l.

In the cleaning method of the present invention, electrolysis is effected by using the stamper as an anode and the opposite electrode plate as a cathode under agitation. The conditions for the electrolysis excepting the voltage polarity are suitably set so that the electrolytic temperature is 40° to 90° C., preferably 50° to 60° C., the electrolytic current density is 1 to 30 A/dm$^2$, and the electrolysis time is 1 minute is 1 minute or more, generally 1 to 60 minutes, for each stamper.

The cleaning method of the present invention is used for removing the photosensitive resin film remaining on the stamper immediately after it has been separated from a glass matrix. However, the cleaning method can be also used for removing dust or foreign matter which adheres to the stamper or possibly adheres to it after the resin film has been removed.

The alkali electrolytic cleaning solution containing ethylenediaminetetraacetic acid and/or a alkali salt thereof can be used as a cleaning solution in the conventional method of cleaning stampers which uses as a cathode the stamper and an anode the opposite electrode plate. In this case, an attempt can be made to increase the degree of cleaning and the reliability of cleaning during continuous cleaning for a long time. The EDTA-containing cleaning solution itself is thus useful in the field of the invention.

EXAMPLE

The present invention is described below with reference to examples. The present invention is not limited to the examples.

i) Stamper cleaning apparatus

An example of an apparatus for performing the stamper cleaning method of the present invention is first described below.

The apparatus shown in FIG. 1 comprises an electrolytic bath 5 in which an alkali electrolytic cleaning solution 4 is stored as an electrolytic solution, a cleaning jig (anode) 6 which can suspend and hold a nickel metal stamper S and which is made of nickel metal which is the same material as that of the stamper S, an opposite electrode plate (cathode) 7 made of nickel metal which is the same material as that of the stamper S, a power source (not shown), a heater 8 and an agitator K.

ii) Operation of stamper cleaning apparatus

The stamper S to be cleaned is suspended by the cleaning jig 6 and placed in the cleaning solution. A DC voltage is applied between the cleaning jig (anode) 6 and the opposite electrode plate (cathode) 7 through the power source. As a result, the stamper S is effectively cleaned by the chemical and physical functions such as saponification, permeation, dispersion, emulsification, agitation and the like, which are possessed by the gas vigorously generated by electrolysis and the alkali degreasing solution, and which act on the stamper S. The cleaning solution is replaced when the integrated electrical charging time is a predetermined value.

iii) Treatment after cleaning of stamper

The stamper S, which is cleaned by degreasing in the stamper cleaning apparatus 2, is extracted from the electrolytic bath 5 and then washed with superpure water in a skin by using a shower. The degree of cleaning (the presence of fine particles or dust particles remaining on the surface of the stamper) is judged by observing the light reflected when light is applied to the stamper S by the light guide of an irradiator while regulating the angle of the stamper S. If an unsatisfactory degree of cleaning is obtained, the stamper is again washed with ultrapure water, while if a satisfactory degree is obtained, the stamper is inserted into a drying chamber in which it is dried by clean air heated (for example, 40° C.).

In this way, the stamper cleaned with a desired degree of cleaning (remaining fine particles or dust particles: 0.1 mμ or less) is obtained.

EXAMPLE 1

As shown in FIG. 1, a stamper S for duplicating compact disks having an outer diameter of 138 mmϕ and diameter of 37.4 mmϕ was set on the cleaning jig (or an electrode jig) 6 made of nickel after duplication and then suspended in the alkali electrolytic cleaning solution 4. The stamper was cleaned by charging electricity between the cleaning jig serving as an anode, i.e., the stamper serving as an anode (+), and the opposite electrode plate 7 serving as a cathode (−) for 2 minutes After cleaning, the stamper was subjected to the after treatment described above in (iii) until a desired degree of cleaning was obtained. The distributions of defect sizes before and after the cleaning are respectively shown in FIG. 2.

Figure 2:
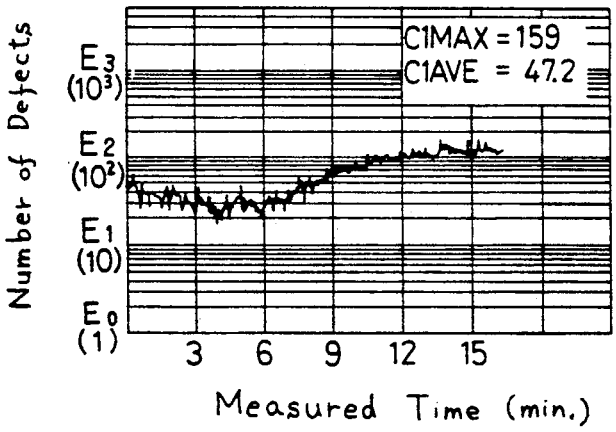
FIG. 2 is a drawing which shows the results of analysis of defect size of the stamper which was cleaned by the cleaning method employed in Example 1.
Figure 2:
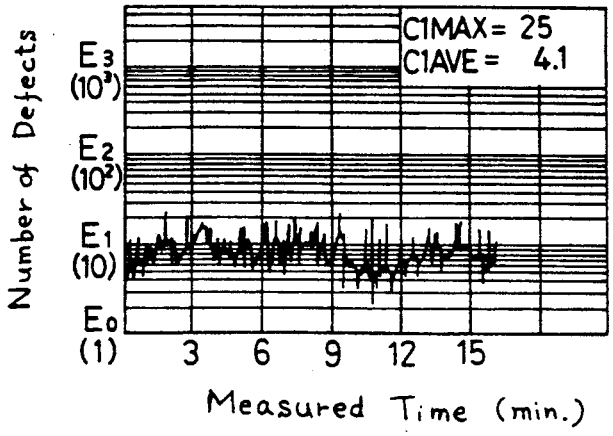

The distributions of defect sizes of the stamper, which are shown in FIG. 2, were obtained from the computer evaluation of the sizes of foreign matter and flaws and the changes thereof (the tendency to decrease and the distribution state) by using the photographs taken by an optical microscope (×100 to 1000). The other conditions are as follows:

| | | |
|---|---|---|
| (a) | Alkali electrolytic degreasing cleaning solution | |
| | Sodium carbonate | 30 g/l |
| | Sodium carbonate | 30 g/l |
| | Sodium phosphate | 50 g/l |
| | Sodium silicate | 30 g/l |
| | Surfactant (Sodium lauryl sulfate) | 1 ml/l |
| (b) | Solution temperature | 60° C. |
| (c) | Current density and voltage | 5 A/dm$^2$, 2.5 V |

EXAMPLE 2

Figure 3:
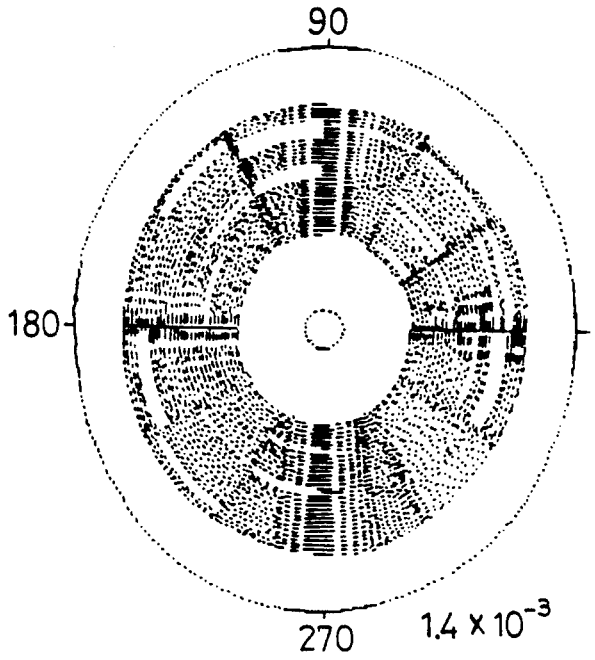
FIG. 3 is a drawing which shows the distributions of defect sizes of the stamper which was cleaned by the cleaning method employed in Example 2.
Figure 3:
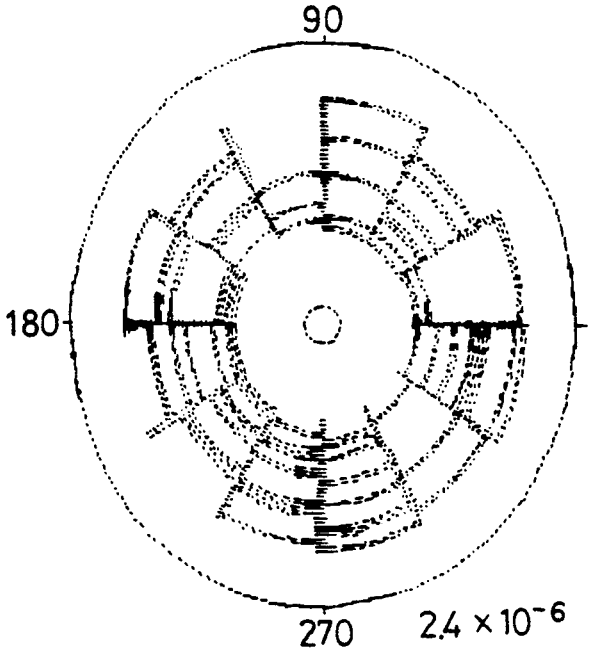

When a stamper S for duplicating DRAW (direct write/read) disks each having an outer diameter of 208 mmϕ and an inter diameter of 65 mmϕ was cleaned by the same method as that employed in EXAMPLE 1, substantially the same results were obtained. The defect distributions before and after the cleaning are shown in FIG. 3. In this example, the defect distributions were observed by visually examining the state of the entire surface of the stamper using a high intensity lighting means (halogen lamp).

EXAMPLE 3

An alkali electrolytic cleaning solution was obtained by dissolving in water the following alkali agents and surfactant:

| | |
|---|---|
| Sodium hydroxide | 40 g/l |
| Sodium carbonate ($Na_2CO_3$) | 40 g/l |
| Sodium phosphate | 65 g/l |
| Sodium silicate | 40 g/l |
| Surfactant (sodium lauryl sulfate) | 0.01 g/l |

Disodium ethylenediaminetetraacetate (EDTA) was added to the cleaning solution so that the concentration was 15 mg/l to obtain a EDTA-containing electrolytic cleaning solution (40 l). The thus-formed cleaning solution contained as ion impurities 0.03 mg/l of iron ions, 0.03 mg/l of aluminum ions and 0.05 mg/l of nickel ions.

The stamper was electrolytically cleaned by the same method as that in EXAMPLE 1 with the exception that the above cleaning solution was used. As a result, the excellent cleaning effect, which was the same was that obtained in EXAMPLE 1, was obtained. When the cleaning method was repeated for a long time, it was found that the life of the cleaning solution is significantly increased, and that the same effect as that described above is exhibited for 6 months or more (2 times that in EXAMPLE 1).

EXAMPLE 4

The alkali electrolytic cleaning solution prepared in EXAMPLE 3 was introduced into an electrolytic bath in which a jig (made of nickel) for suspending a stamper, an opposite electrode plate (made of nickel), a heater and an agitator were placed, and a power source for applying a voltage between the jig and the opposite electrode plate was disposed outside the electrolytic bath to form an electrolytic system.

In this state, an uncleaned stamper (138 mmϕ) was suspended by the jig, and electrolytic cleaning was carried out by using the stamper as a cathode and the opposite electrode as an anode. The electrolytic conditions are as follows:

| | |
|---|---|
| Electrolytic temperature | 50 to 60° C. |
| Electrolytic current density | 10 A/dm$^2$ |
| Electrical charging time | 3 minutes |

The number of defective portions of bits in the cleaned stamper are shown in the table given below together with those of the uncleaned stamper. The table also shows the results obtained in the case of use a cleaning solution having the same composition as that described above without containing disodium EDTA.

| | Average number of defects | | Maximum number of defects | |
|---|---|---|---|---|
| | Before cleaning | After cleaning | Before cleaning | After cleaning |
| Example | 2.2 | 2.1 | 25 | 24 |
| Comparative Example (No addition of EDTA) | 0.8 | 76.9 | 24 | 135 |

As seen from the table, in the case where the EDTA-containing alkali electrolytic cleaning solution was used, the number of defective portions is not increased regardless of the polarity of the stamper in the electrolytic system, and the fine particles of metal impurities are completely prevented from depositing or adhering on the stamper. It therefore possible to increase the reliability of electrolytic cleaning.

What is claimed is:

1. A method of electrolytically cleaning a stamper after it has been fabricated comprising:

providing an electrolytic stamper cleaning solution;

suspending a stamper on an electrode jig and opposite thereto an electrode plate in the cleaning solution; the stamper, the opposite electrode plate and the electrode jig each being made of substantially the same material; and applying a DC voltage between the stamper and the opposite electrode so that the stamper serves as an anode and the electrode serves as a cathode to perform electrolytic cleaning.

2. A cleaning method according to claim 1, wherein the electrolytic stamper cleaning solution is an alkali electrolytic cleaning solution.

3. A cleaning method according to claim 2, wherein the alkali electrolytic cleaning solution comprises 3 to 5% by weight of sodium hydroxide, 3 to 5% by weight of sodium carbonate, 5 to 8% by weight of sodium phosphate, 3 to 5% by weight of sodium silicate and a small amount of a surfactant.

4. A cleaning method according to claim 1, wherein the electrolytic stamper cleaning solution comprises an alkali electrolytic cleaning solution and 1 to 1000 mg/l of ethylenediaminetetraacetic acid and/or an alkali salt thereof contained in the solution.

5. A cleaning method according to claim 4, wherein the alkali electrolytic cleaning solution comprises 3 to 5% by weight of sodium hydroxide, 3 to 5% by weight of sodium carbonate, 5 to 8% by weight of sodium phosphate, 3 to 5% by weight of sodium silicate and a small amount of surfactant.

6. A cleaning method according to claim 1, wherein the stamper is made of nickel, cobalt, platinum, molybdenum, chromium, tungsten, vanadium, niobium, tantalum, palladium or gold.

7. The method of claim 1, additionally comprising the step of agitating said cleaning solution while said voltage is applied.

8. An electrolytic stamper cleaning solution which comprises an alkali electrolytic cleaning solution and 1 to 1000 mg/l of ethylenediaminetetraacetic acid and/or an alkali salt thereof contained in the solution, and wherein said alkali electrolytic cleaning solution comprises 3 to 5% by weight of sodium hydroxide, 3 to 5% by weight of sodium carbonate, 5 to 8% by weight of sodium phosphate, 3 to 5% by weight of sodium silicate and a small amount of surfactant.

* * * * *